US005471711A

United States Patent [19]

Koyacs et al.

[11] Patent Number: 5,471,711

[45] Date of Patent: Dec. 5, 1995

[54] PROCESS AND DEVICE FOR THE STORAGE OF TEXTILE CANS

[75] Inventors: Otmar Kovacs, Dietfurt; Michael Ueding , Ingolstadt; Bernhard Mohr, Titting/Altdorf, all of Germany

[73] Assignee: Rieter Ingolstadt Spinnereimaschinenbau AG, Ingolstadt, Germany

[21] Appl. No.: 244,438

[22] PCT Filed: Oct. 4, 1993

[86] PCT No.: PCT/EP93/02708

§ 371 Date: May 25, 1994

§ 102(e) Date: May 25, 1994

[87] PCT Pub. No.: WO94/08079

PCT Pub. Date: Apr. 14, 1994

[30] Foreign Application Priority Data

Oct. 5, 1992 [DE] Germany ..... 42 33 357.1

[51] Int. Cl.[6] ..... D01H 9/18

[52] U.S. Cl. ..... 19/159 A

[58] Field of Search ..... 19/159 A; 57/90

[56] References Cited

U.S. PATENT DOCUMENTS

| | | | |
|---|---|---|---|
| 4,012,893 | 3/1977 | Weber | 19/159 A |
| 4,033,104 | 7/1977 | Kamp | 19/159 A |
| 4,227,848 | 10/1980 | Kriechbaum | 19/159 A |
| 4,694,539 | 9/1987 | Langen | 19/159 A |
| 4,735,040 | 4/1988 | Pricher | 19/159 A |
| 5,086,616 | 2/1992 | Gunkinger | 19/159 A |

FOREIGN PATENT DOCUMENTS

| | | |
|---|---|---|
| 1266672 | 12/1968 | Germany . |
| 3924274A1 | 1/1991 | Germany . |
| 4018088A1 | 1/1991 | Germany . |
| 4015938A1 | 11/1991 | Germany . |
| 9118135 | 11/1991 | Germany . |
| 4132819A1 | 4/1992 | Germany . |

*Primary Examiner*—C. D. Crowder
*Assistant Examiner*—Ismael Izaguirre
*Attorney, Agent, or Firm*—Dority & Manning

[57] ABSTRACT

With a process and a device full cans taken from the storage device for the storage of cans are replaced by empty cans. The storage device is displaced for the reception and the removal of the can. As required, an empty can holding space, an empty can, or a full can is brought to a can grasping device. The device is a carriage with a storage device. Empty or full cans are arranged on the carriage in such manner that the empty cans are deposited at one end of the carriage. The full cans are deposited at the other end of the carriage.

28 Claims, 6 Drawing Sheets

PROCESS AND DEVICE FOR THE STORAGE OF TEXTILE CANS

BACKGROUND OF THE INVENTION

The instant invention relates to a process and to a device for the storage of cans, in particular at a fiber sliver producing machine which is fed empty cans from the storage device and from which full cans are conveyed to the storage device, in which the filled cans are taken out of the storage device and are replaced by empty cans.

Processes and devices of this type are known from DE 40 15 938 wherein a can conveying vehicle here moved to a can storage device and deposits an empty can in a storage device provided for empty cans. The can conveying vehicle then continues to travel for a given distance so that it is able to receive a full can from a storage device for full cans. The empty cans as well as the full cans in the storage device are conveyed by means of a retaining conveyor to a respective receiving station. The storage device must furthermore be laid out so that the same number of empty cans as full cans can be accommodated in it at the same time. This means that much space is required for the can storage.

The retaining conveyor can deliver empty cans only at the end of the retaining path for the empty cans. Full cans on the other hand, can be received reliably only at the beginning of the retaining path. This has the disadvantage that the can conveying vehicle must travel to several locations to deliver and to receive the cans.

OBJECTS AND SUMMARY OF THE INVENTION

It is therefore a principal object of the instant invention to create a process and a device by means of which cans can be placed in a storage device and can be taken from same at low construction and control costs. Additional objects and advantages of the invention will be set forth in part in the following description, or will be obvious from the description, or may be learned through practice of the invention.

According to the invention the storage device is shifted for the reception or delivery of the can, so that an empty can or a full can may be brought as needed to an empty can receiving site. It is advantageous in this process according to the invention that control of only the storage device is required. The feeding and receiving of cans takes place advantageously at one and the same location. Shifting and sophisticated positioning of the device to receive and deliver cans from and into the storage device is avoided. The needed location on the storage device is always presented to the can grasping device by shifting the storage device. This enables the can grasping device either to take up an empty or a full can or to deposit an empty or a full can on the empty can receiving site.

By using the storage device as a replaceable storage device it becomes advantageously possible to exchange a storage device containing full cans against a storage device with empty cans. As a result, stoppages during the filling of cans are avoided to a great extent. If fewer full cans are taken from the storage device than are conveyed by the machine to the storage device, the completely full storage device can be removed manually or automatically from the machine and can be replaced by a storage device with empty cans.

The removal of a full can from the storage device takes place advantageously at a point in time when another can is outside the storage device, e.g., as the can is being filled. At this point in time, the storage device contains an empty can holding space on which a received full can is deposited in the storage device against an empty can. An orderly depositing of the cans in the storage device and thereby the possibility of carrying out a can exchange through a slight movement of the storage device is possible if the full cans are deposited on one side of the storage device, and the empty cans on the other side of the storage device.

Advantageously, an empty can is deposited in the storage device against a full can which is taken from the storage device. In this manner, the same number of cans are always present in the storage device before and after the can exchange. To maintain the orderly management of the storage device, it is advantageous if the can taken out of the storage device is always the first full can as seen from the direction of the empty cans. In keeping with this principle, it is equally advantageous if the full can which follows the row of empty cans is the first can to be taken from the storage device.

The exchange of the empty can against the full can advantageously takes place in such a manner that a depositing site is free between the empty cans and the full cans after completion of the exchange. The can which is in the machine to be filled is put back on this depositing site and is placed at the end of the row of full cans. The empty can next to this replaced full can is taken from the storage device following a shift of the storage device by one can holding space and is conveyed to the machine to be filled. A free can holding space has again thus been created and can be used by a can conveying vehicle to deposit an empty can. If an empty can holding space on the can conveying vehicle is on the side of the full cans of the storage device, a reception of the full can and a delivery of the empty can is possible without a long shifting distance or multiple positioning of the storage device.

According to the invention, the can storage device is a carriage on which empty and/or full cans are placed in such a manner that the empty cans are standing at one end of the carriage and the full cans at the other end. Through this arrangement of the empty and full cans on the carriage, the above-described process in particular can be carried out in an advantageous manner. The carriage is open on both sides in its longitudinal sense so that it can be loaded with cans and so that cans can be unloaded from it. Thereby it is possible for grasping devices to grasp from both sides of the carriage the cans standing on said carriage. By means of a friction wheel drive which attacks at a friction surface of the carriage, the carriage can be shifted by one can holding space at a time. By offsetting the counter roller of the friction wheel drive, the adjustment in height of the carriage can be made in the simplest manner possible so that the grasping devices are able to grasp the cans and to move them at defined locations.

Lateral guides on the carriage cause cans to be deposited on can holding spaces with lateral guides. A defined holding space for the cans is achieved by the lateral guides.

If one can holding space more than necessary for the cans to be filled is provided on the carriage, and in particular in the case where only empty or only full cans are present on the carriage, the exchange against a full or empty can according to the same process as for a mixed charge of the carriage is made possible. The can exchange may also take place at a location where a can is not taken from the storage device to be filled at a machine.

If the carriage width is smaller than the can diameter or the can length, the projection of the can beyond the carriage facilitates the taking up of the cans. A can grasping device is able to reach beneath the cans and to push them off or on the carriage.

For the positioning of the carriage in order to position a can holding space in relation to a can grasping device, it is advantageous if a positioning device is assigned to each can holding space of the carriage.

By providing a sensor, the can conveying vehicle can be signalled the readiness of cans on the carriage to be received or deposited. This makes it possible to avoid that the grasping device of the can conveying vehicle reaches for the cans on the carriage while a can that has just been filled is being deposited by the machine on the carriage. Furthermore, the machine can thus be informed that a can exchange is being carried out at that moment by means of the can conveying vehicle so that the conveying device of the machine may not take up a can.

Examples of embodiments of the instant invention are described through the figures.

DETAILED DESCRIPTION OF THE PREFERRED EMBODIMENTS

Figure 1D:
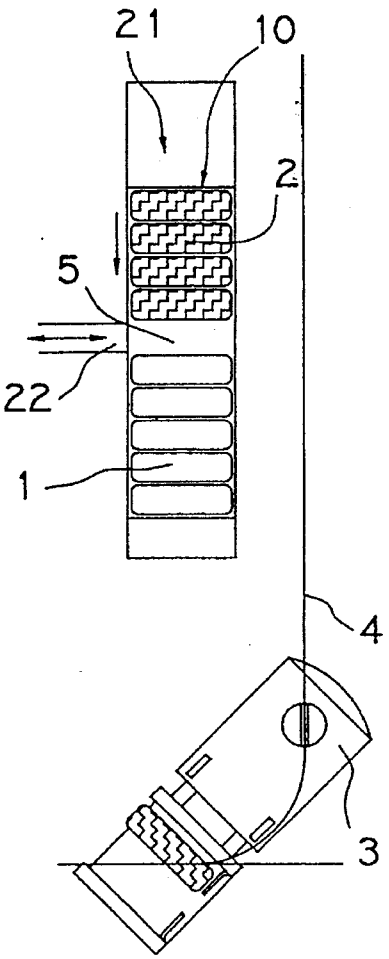
FIG. 1*a–c* shows a device and a process to shift a can storage device.

Reference will now be made in detail to the presently preferred embodiments of the invention, one or more examples of which are illustrated in the drawings. Each example is provided by way of explanation of the invention, and not as a limitation of the invention. It will be obvious to those skilled in the art that various modifications and variations can be made in the present invention without departing from the scope or spirit of the invention. Additionally, the number of components is consistent throughout, with the same components having the same numbers.

The sequence of a can replacement in a storage device is shown in FIGS. 1*a*–1*d*.

Figure 1C:
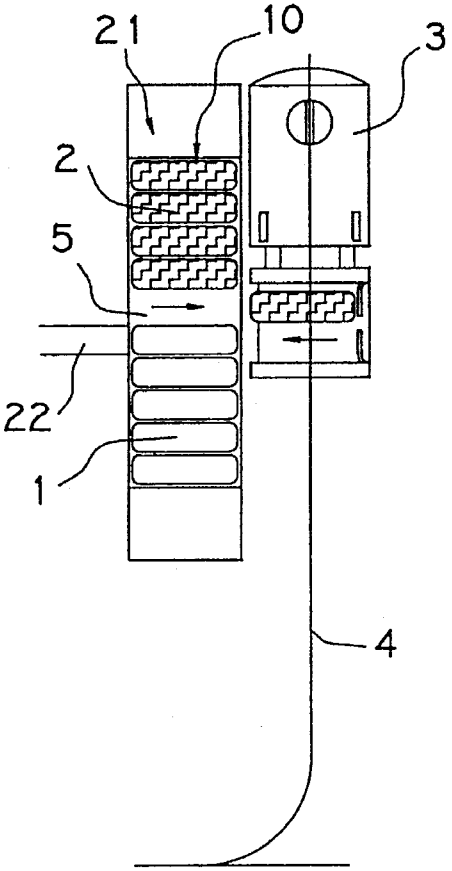
Figure 1B:
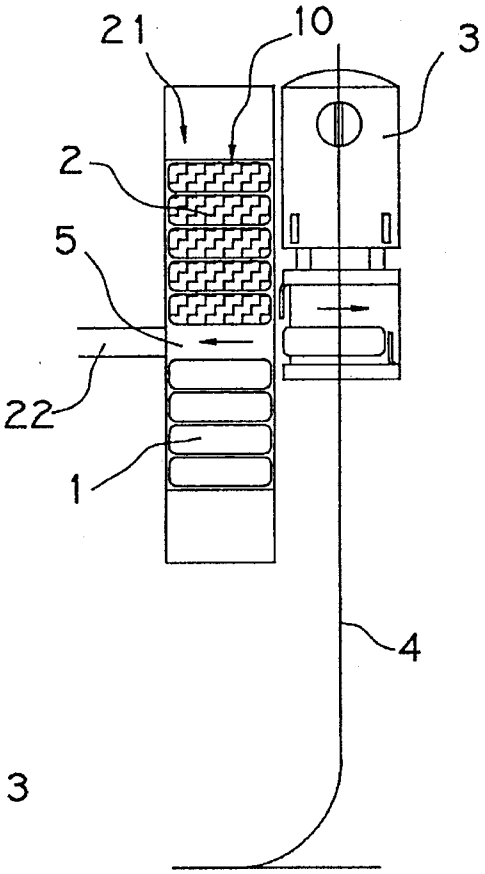
Figure 1A:
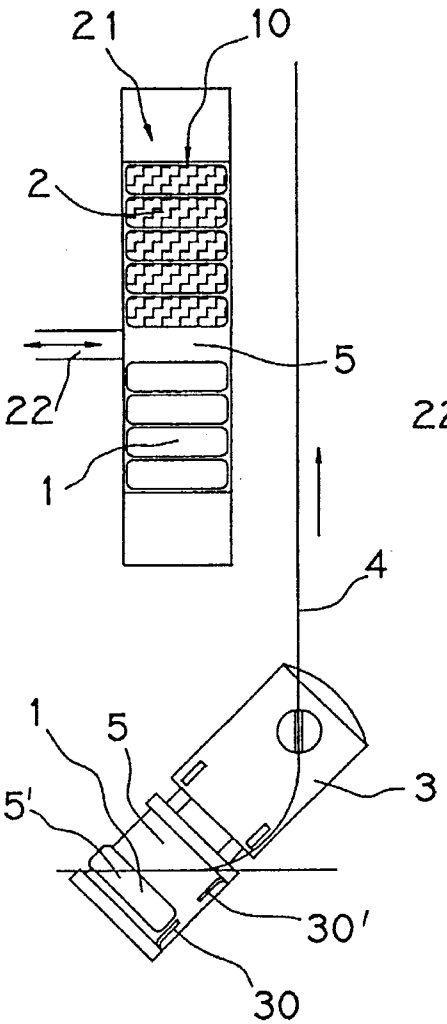

FIG. 1*a* shows a carriage 10 serving as a storage device for empty cans 1 and full cans 2. The carriage 10 can be moved back and forth within the displacement zone 21. A free can holding space 5 is provided between the empty cans 1 and the full cans 2. A can which is not shown and which is placed between the empty cans 1 and the full cans 2 on this free can holding space 5 is conveyed out of the storage device on a conveyor 22, e.g., to be filled with fiber sliver. This can (which is not shown) is conveyed back to the storage device upon completion of the filling process on the conveyor 22. A can conveying vehicle 3 travels along track guide 4 in the direction of the arrow into the vicinity of the carriage 10. The can conveying vehicle 3 stops at a defined position next to the carriage 10. Two can holding spaces 5, 5' are provided on the can conveying vehicle 3. The can holding spaces 5, 5' in the vehicle 3 of this embodiment are located behind the actual can conveying vehicle 3. The can conveying vehicle 3 is loaded with an empty can 1 on the one can holding space. The second can holding space 5' on the can conveying vehicle 3 is empty. A can grasping device 30, 30' is associated with the can holding space 5, 5'. The cans are received from the can conveying vehicle 3 and are deposited by means of this can grasping device 30, 30'.

In FIG. 1*b* the can conveying vehicle 3 is in position next to the carriage 10. The position of the can conveying vehicle 3 is such that the empty can 1 on the can conveying vehicle 3 is across from the empty can holding space 5 of the carriage 10. In this position, the grasping device 30' is extended and grasps the full can 2 standing next to the empty can holding space 5 of the carriage 10. The empty can 1 is pushed by the grasping device 30 on the empty can holding space 5 of the carriage 10. By retracting the grasping device 30' the full can 2 is pulled from the carriage 10 onto the can conveying vehicle 3. The grasping device 30 is uncoupled from the empty can 1 and is also retracted (FIG. 1*c*).

After the successfully completed can exchange on the track guide 4, the can conveying vehicle 3 travels away from the storage device according to FIG. 1*d* and carries out its conveying task, e.g., by travelling to a fiber sliver processing spinning machine, and exchanges the full can 2 against an empty can 1 at that location. The carriage 10 is moved forward by one can holding space so that the empty can holding space 5 on the carriage 10 is again across from the conveyor 22. The carriage 10 is thus ready to take back the can which was removed to be filled.

The loading and unloading of the can is carried out through a grasping device 30 which is not described in further detail. This grasping device 30 may be designed so that it grasps the can 1, 2 with a hook at a handle provided for that purpose, lifts the can when required and places it on the carriage 10 or removes it from same. The hook, however, advantageously hooks in below the can 1, 2 to move said can 1, 2. In this manner, no or only minor structural changes, such as reinforcement of the sides of the cans beyond what is found in standard cans, are required. Can grasping devices of this described type are suitable for the carriage 10 as well as for the conveyor 22.

Figure 2C:
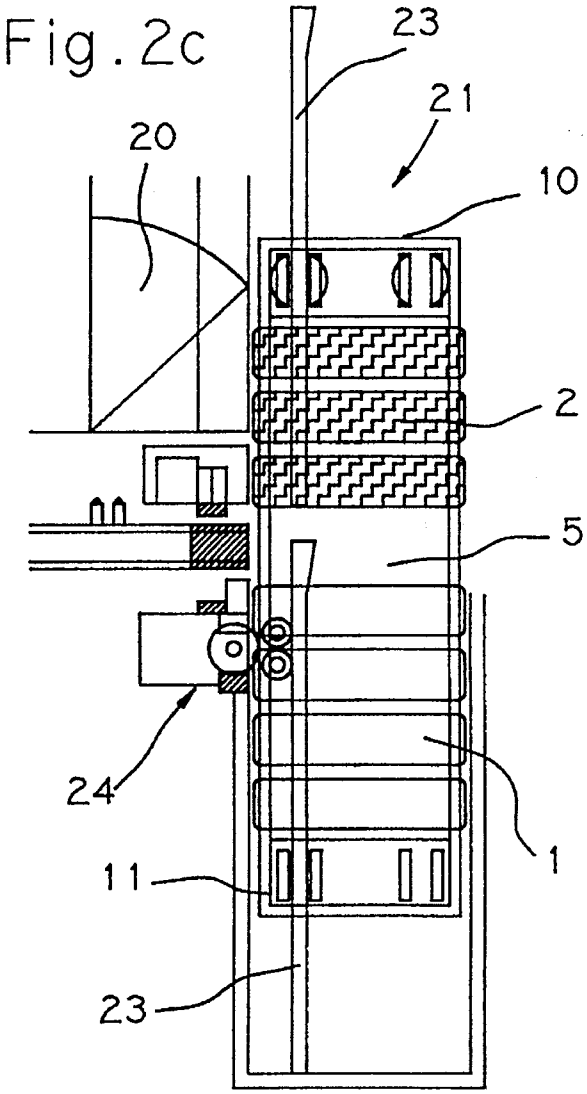
Figure 2B:
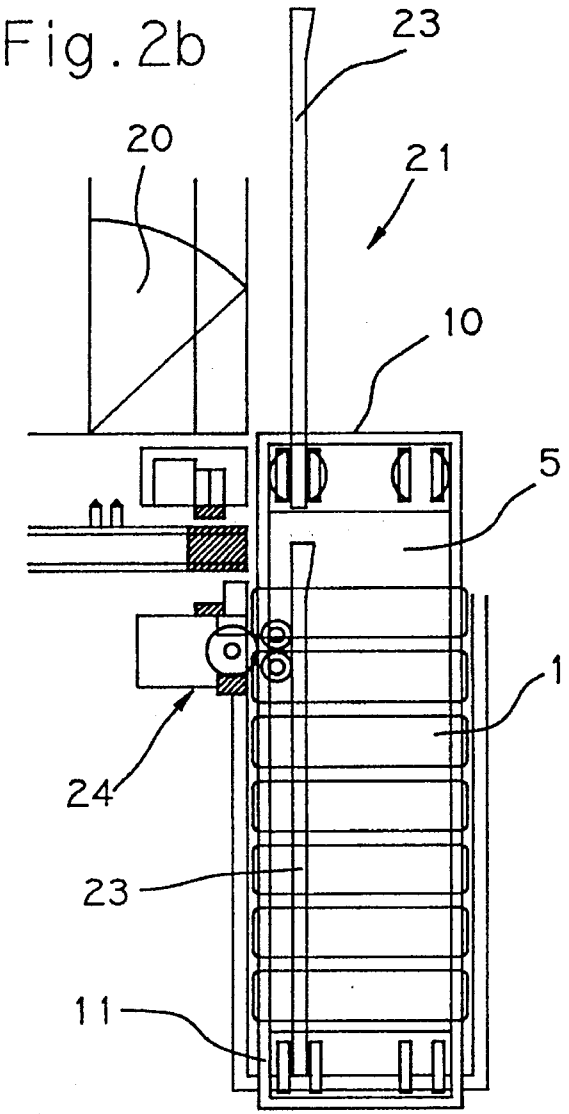
Figure 2A:
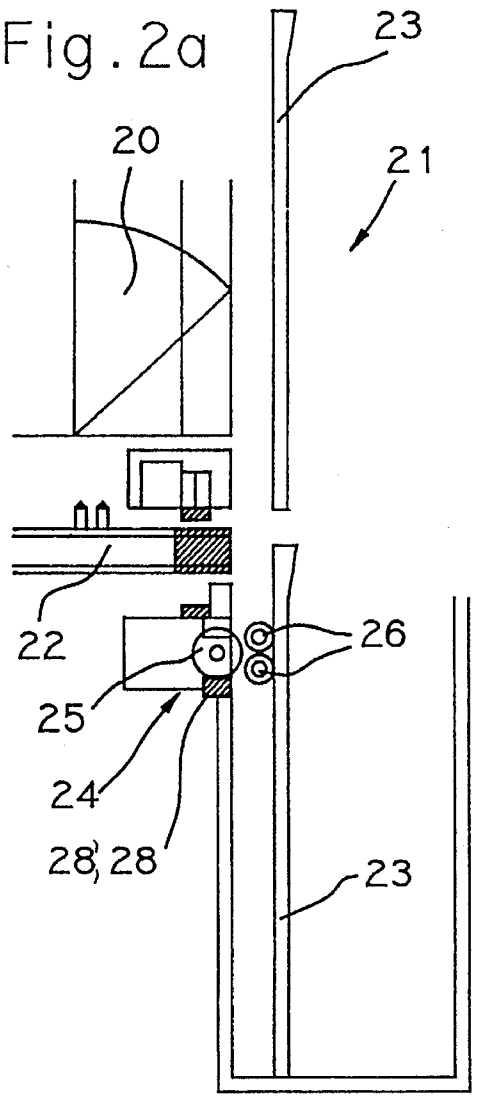

FIGS. 2*a* –2*c* show the storage device in greater detail. The displacement zone 21 is located next to a machine 20. The conveyor 22 is provided to convey the cans from the carriage 10 to the machine 20. The conveyor 22 grasps a can 1 and conveys it from the carriage 10 to the machine 20. The can 1 can be filled at the machine 20, e.g., with fiber sliver. Following the filling process, the can 2 which is now full is conveyed back to the carriage 10 by means of the conveyor 22. Guides 23 are provided in the displacement zone 21. The carriage 10 is introduced by its wheels into these guides 23. This ensures guidance of the carriage 10 as it moves back and forth, even if the carriage 10 should be subjected to an impact.

In addition to the conveyor 22, a friction wheel drive 24 is provided. In the friction wheel drive 24, a friction wheel 25 interacts with two opposing rollers 26. The carriage 10 is moved back and forth by the friction wheel drive 24. For this purpose, the carriage 10 is introduced by string piece 11 between the friction wheel 25 and the opposing rollers 26. The friction wheel 25 thus presses against the string piece 11 which in turn bears upon the opposing rollers 26. This produces a sufficiently strong frictional contact by which the carriage 10 can be driven.

As shown in FIG. 2*b*, the carriage 10 is pushed completely into the storage device at the beginning of the filling process. The carriage 10 is in an end position of the displacement zone 21 at the beginning of the filling process. A can is taken from the carriage 10 via the conveyor 22. This creates a free can holding space 5 on the carriage 10.

According to FIG. 2*c* the carriage 10 is pushed in the direction of the other end of the displacement zone 21 as individual cans are being filled. As the individual cans are being filled, full cans 2 are placed at one end of the carriage 10 and empty cans 1 at the other end of the carriage 10. While a can is being filled, an empty can holding space 5 exists between the empty cans 1 and the full cans 2. The full can 2 is pushed back into this empty can holding space 5, the carriage 10 is moved on by one can holding space and the next empty can 1 can be conveyed to the machine 20 by means of the conveyor 22 in order to be filled.

Figure 3:
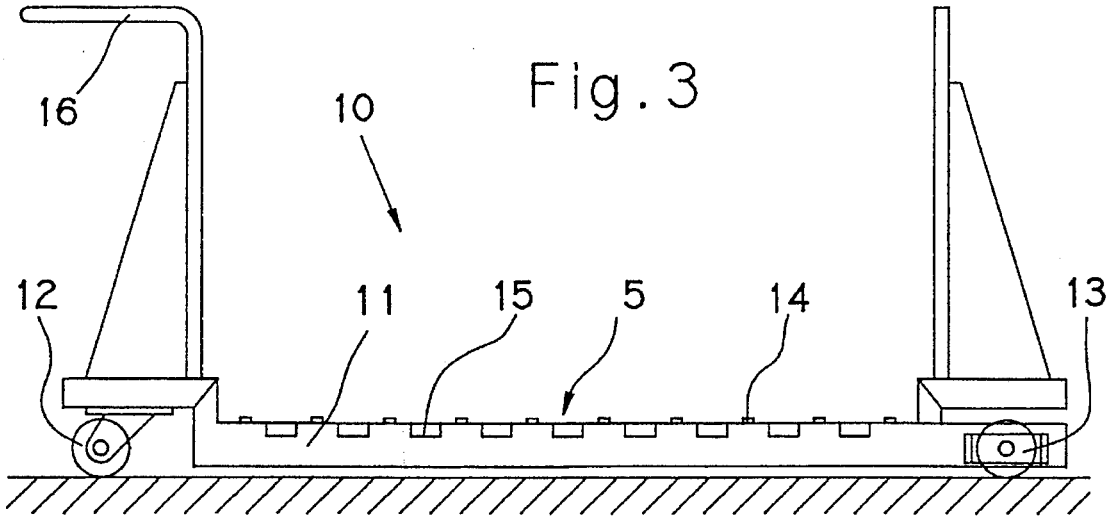
FIGS. 3 and 4 show a carriage serving as a can storage device.

FIG. 3 shows a side view of the carriage 10. Wheels 12 and 13 are connected to each other via a string piece 11. The wheels 12 are designed to be steering wheels, so that the carriage 10 is able to travel outside the storage device. Can guides 14 are provided on the string piece 11. The distance between the can guides 14 ensures defined depositing of the cans on the can holding spaces 5.

Sensor recesses 15 are provided in the string piece 11. The sensor recesses 15 interact with two sensors 28, 28' (FIG. 2) on the storage device. The sensors detect the end of a sensor recess 15. This makes it possible to place the can holding spaces 5 precisely in relation to the conveyor 22 from both travel directions of the carriage 10. The sensors 28, 28' are located next to the conveyor 22 so that they do not hinder the conveying path of the cans. Accordingly, the recesses 15 are located on the string piece 11 next to the appertaining can holding space 5 to be positioned.

A handle 16 is provided on the carriage 10. The carriage 10 with empty cans 1 can be pushed into the storage device by means of the handle 16 and can again be removed from the storage device when the cans have been filled. This advantageously enables the machine 20 to continue filling empty cans, even when a carriage 10 is already full. The full carriage 10 can be brought into a storage space from which it is gradually unloaded according to the process of the invention, e.g., by means of can conveying vehicles 3. Similarly, it is possible for the carriage 10 with full cans to be pulled to fiber processing machines, for example, and for the empty cans to be exchanged there manually against the full cans of the carriage 10.

Figure 4:
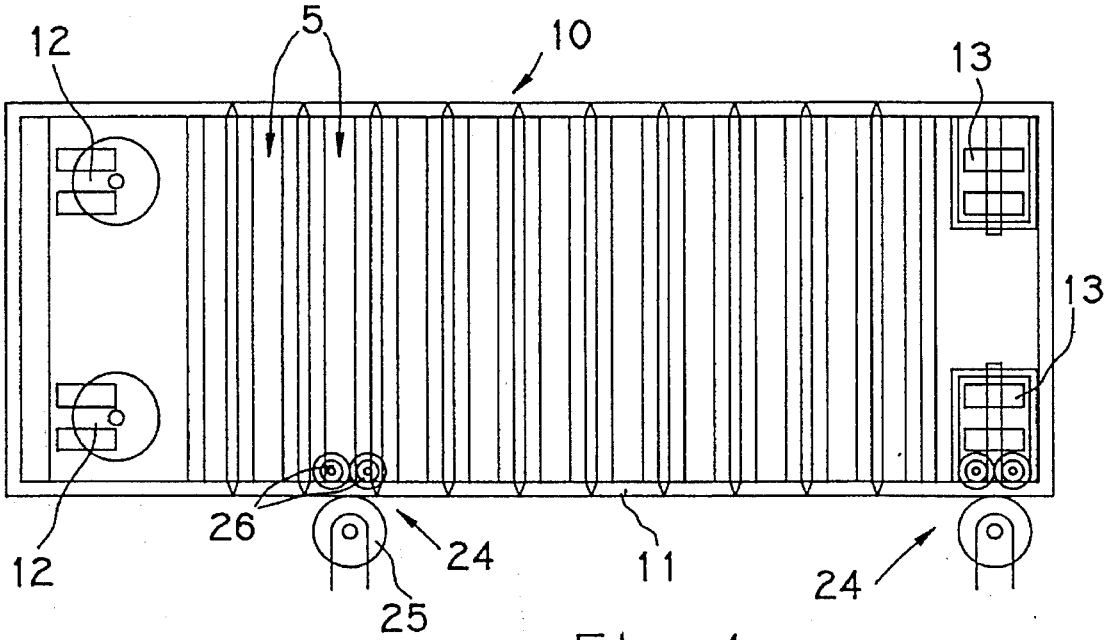

FIG. 4 shows a top view of a carriage 10. The carriage 10 can be moved by means of the steering wheels 12 and the fixed wheels 13. Near the storage device, the string piece 11 is coupled to the friction wheel drive 24. The string piece 11 is located here between the friction wheel 25 and the opposing rollers 26. In the drawing of FIG. 4, two positions of the friction wheel drive 24 are shown. The position of the friction wheel drive 24 shown in FIG. 4 at the left is the position at the beginning of the process of filling the cans on the carriage 10. During the filling process, the carriage 10 moves step by step to the left so that finally, when the last can is being filled, the position of the friction wheel drive 24 at the right in relation to the carriage 10 is reached. The string piece 11 must therefore be designed so that it enables the carriage 10 to be positioned also for the last can holding space by means of the friction wheel drive 24.

Figure 5:
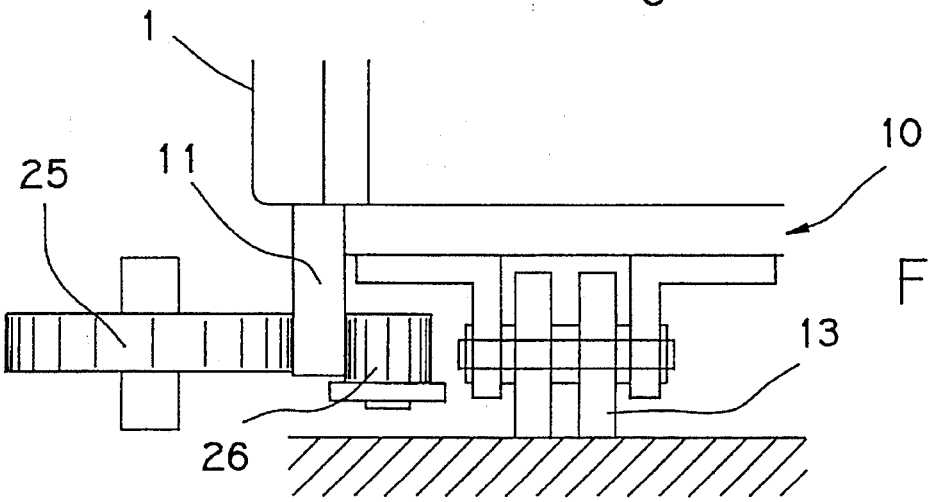
FIG. 5 shows a friction wheel drive.

FIG. 5 shows a sketch of the friction wheel drive 24. The friction wheel 25 pushes here the string piece 11 against the opposing roller 26. This produces sufficient frictional contact so that the carriage 10 can be moved. The diameter of opposing roller 26 is offset. This advantageously causes the height-alignment of the carriage 10 in relation to the can conveying vehicle 3 and to the conveyor 22 to be always such that proper transfer of the can 1 is possible.

As FIG. 5 shows, can 1 projects laterally beyond the carriage 10. This advantageously makes it possible for the can 1 to be grasped by a grasping device of the conveyor 22 and by a grasping device 30 or 30' of the can conveying vehicle 3. It has been shown to be advantageous here for a hook to be pushed beneath the can 1 which catches the can 1 during retraction.

Figure 6B:
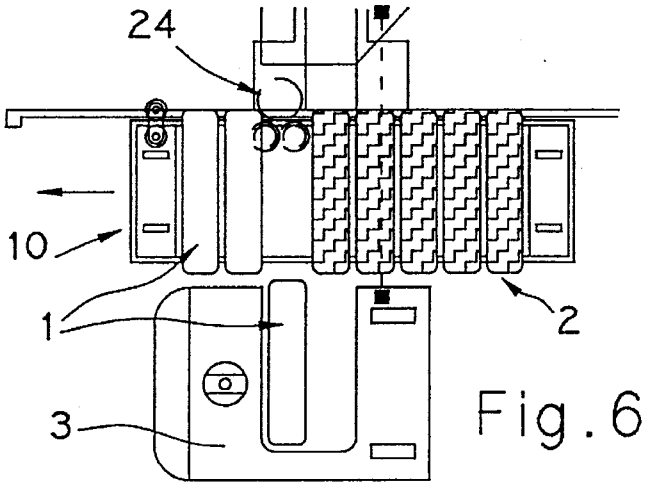
FIG. 6*a–c* shows a can replacement process.
Figure 6C:
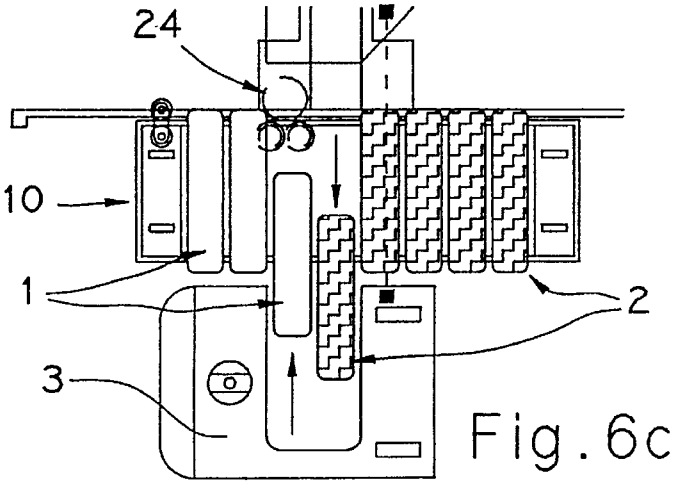
Figure 6A:
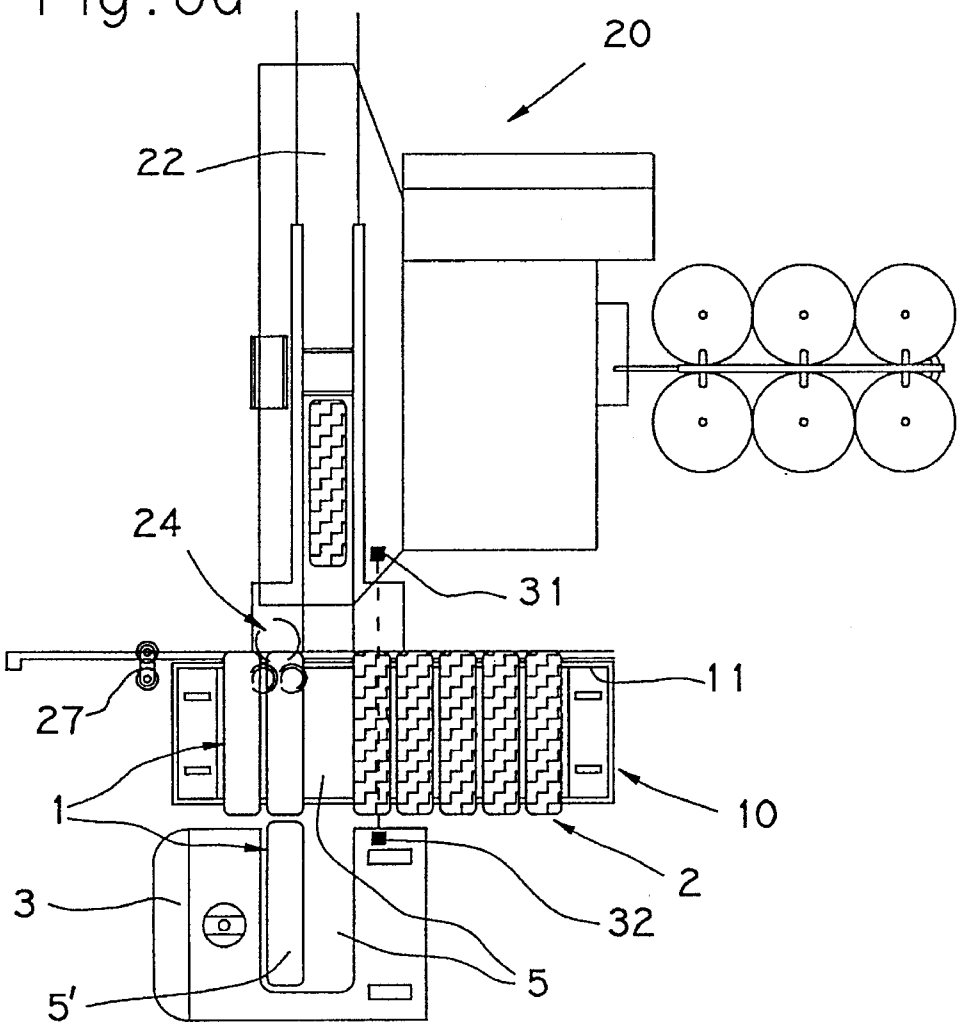

FIGS. 6*a*–6*c* show another evolution of the can transfer process. In the can conveying vehicle 3 shown in these figures, the can holding spaces are located in the undercarriage. Contrary to the vehicle 3 of FIGS. 1*a*–*d*, the empty cans are at the front, in the direction of travel. This is advantageous, especially for the exchange of the cans at a machine for further processing of fiber slivers, since the exchange may be carried out without any need for the vehicle 3 to travel in reverse.

In FIG. 6*a* the can conveying vehicle 3 is positioned in such manner next to the storage device that its empty can 1 faces the first empty can (as seen from the direction of the full can 2) of the carriage 10. The free can holding space 5 of carriage 10 is next to this first empty can 1 of the carriage 10. The can 2 assigned to this empty can holding space 5 is on the conveyor 22 which conveys the can 2 to the machine 20 in this embodiment. The can conveying vehicle 3 announces itself via a signal generator 31 at a corresponding sensor 32 of machine 20. The can conveying vehicle 3 is informed by signal via this signal generator 31 and sensor 32 whether a can exchange between the can conveying vehicle 3 and the carriage 10 may be carried out. In case that a conveying process is being carried out at that moment via conveyor 22, the can exchange is not enabled.

Upon completed release, the carriage 10 is displaced by one can holding space according to FIG. 6*b*. This causes the empty can 1 of the can conveying vehicle 3 to stand across from the free can holding space 5 of the carriage 10. The can exchange takes place in this position according to FIG. 6c. The empty can 1 of the can conveying vehicle 3 is pushed onto carriage 10, while the first full can 2 of the carriage 10 is moved on the can conveying vehicle 3. Following this can exchange, the free can holding space on carriage 10 is again across from the conveyor 22 and is ready to receive the can just filled at machine 20.

The example of the embodiment according to FIGS. 6*a*–*c* shows a carriage 10 which is moved back and forth without guides 23 in the displacement zone. As a protection against mechanical influences on the carriage, guide rollers 27 are installed on the storage device and are surrounded by the string piece 11 of the carriage 10. This ensures precise guidance of the carriage 10.

It is common to all of the embodiments that the can conveying vehicle 3 moves into such proximity of the carriage 10 that the grasping devices 30, 31 are able to deposit cans on the carriage 10 or to take them up from the carriage 10. The can conveying vehicle 3 is moved towards the carriage 10 so that the empty can 1 conveyed on the can conveying vehicle 3 is located on the can holding space of the can conveying vehicle 3 which is on the side of the empty can 1 of carriage 10. In this manner few movements of carriage 10 and can conveying vehicle 3 are required in order to carry out the can exchange and to bring the carriage 10 back into its receiving position for a can that has just been filled. In any case it must be ensured that the free can holding space 5 on the carriage 10 is between the empty and the full cans after the exchange of cans between carriage 10 and can conveying vehicle 3. By maintaining this order, advantageous exchanging of the cans according to the same principle is always possible. It is furthermore a characteristic of the principle according to the invention that the full can taken from the carriage 10 is always the one placed directly next to the empty can holding space or next to the empty cans. Thereby the can filled last is taken first from the carriage 10.

The invention applies of course not only to the long cans shown in the figures, but also to round cans. The can exchange between carriage 10 of the storage device and the can conveying vehicle 3 may also take place independently of any machine 20. This means that a full carriage 10 may be conveyed into a storage area and is gradually emptied there by a can conveying vehicle 3. Several carriages 10 can also be attached together into a train. In this manner, it is possible to increase the contents of the can storage device. Machines whose cans have been emptied can be supplied more efficiently if several carriages are brought to this machine. This is especially interesting when the machine with empty cans is to be supplied completely with new cans, as may be the case when batches are changed on rotor spinning machines. In that case a plurality of cans is conveyed to the rotor spinning machine and the cans may be exchanged by section. It may be advantageous in that case if the cans are constantly on a carriage 10 even at the rotor spinning machine. In this manner it is possible to remove a carriage 10 at the rotor spinning machine with empty cans or with fiber sliver which is no longer needed from the rotor spinning machine and to replace it by a carriage 10 with new fiber slivers in the cans.

Depending on the degree of automation of the installation it may be advantages for the carriages 10 to be able to travel autonomously in the manner of a driverless conveying system similar to the can conveying vehicle 3. In that case the carriages 10 go into a predetermined position when the desired fullness of the cans has been reached, and liberate the storage device at the machine 20 for a new carriage 10.

Figure 7C:
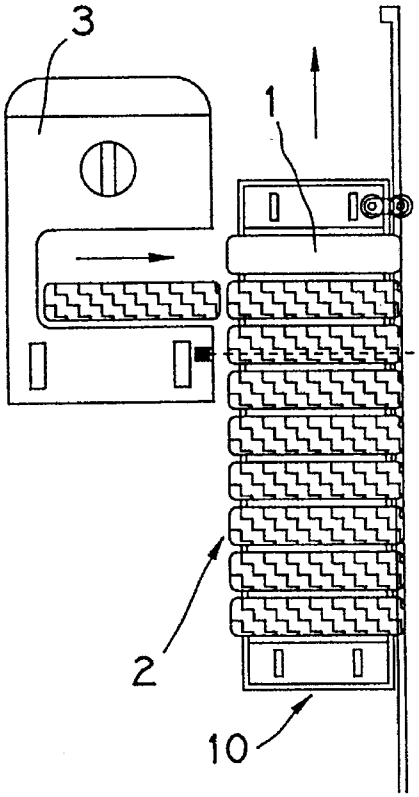
FIG. 7*a–c* shows a can replacement process.
Figure 7B:
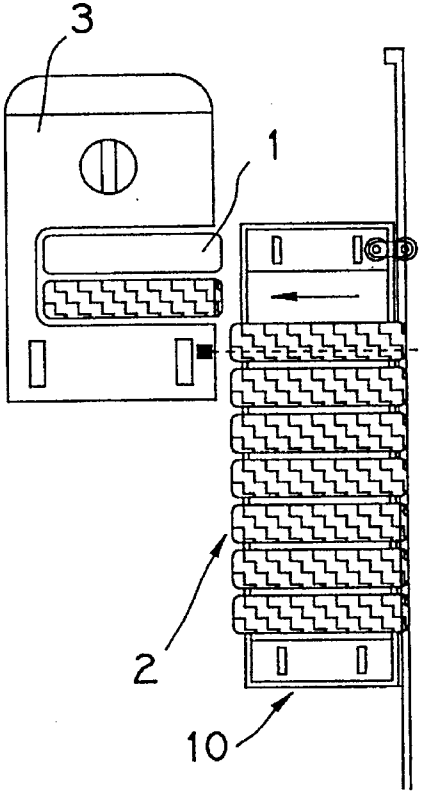
Figure 7A:
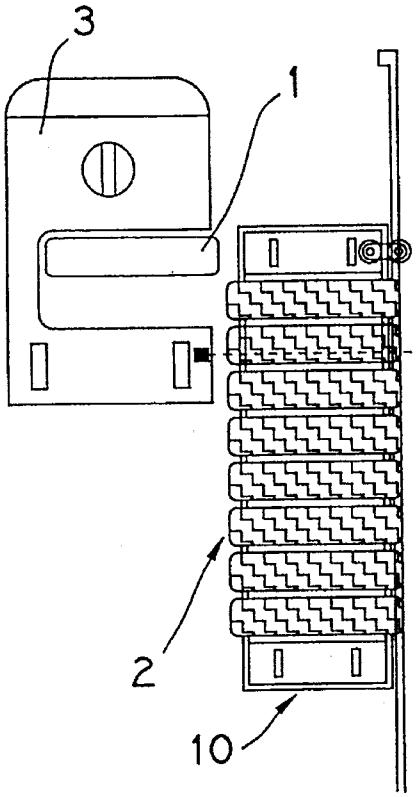

FIGS. *7a–7c* show an exchange process with a full carriage 10. According to FIG. 7, the can conveying vehicle 3 is placed next to the carriage 10. The position is advantageously such that the free can holding space 5 of the can conveying vehicle 3 is across from a full can 2 of carriage 10. A full can 2 is then transferred from the carriage 10 to the can conveying vehicle 3. A movement of the carriage 10 according to FIG. *7c* in the direction of the empty can 1 of the can conveying vehicle 3 causes the free can holding space 5 of the carriage 10 to be brought into a receiving position. The empty can 1 is then surrendered by the can conveying vehicle 3 and is placed on the can holding space of the carriage 10. If necessary, the carriage 10 is then brought into a position (not shown) from which either the empty can 1 may be taken to be filled again, or the full cans 2 may be readied to be picked up by an additional can conveying vehicle 3.

Figure 8:
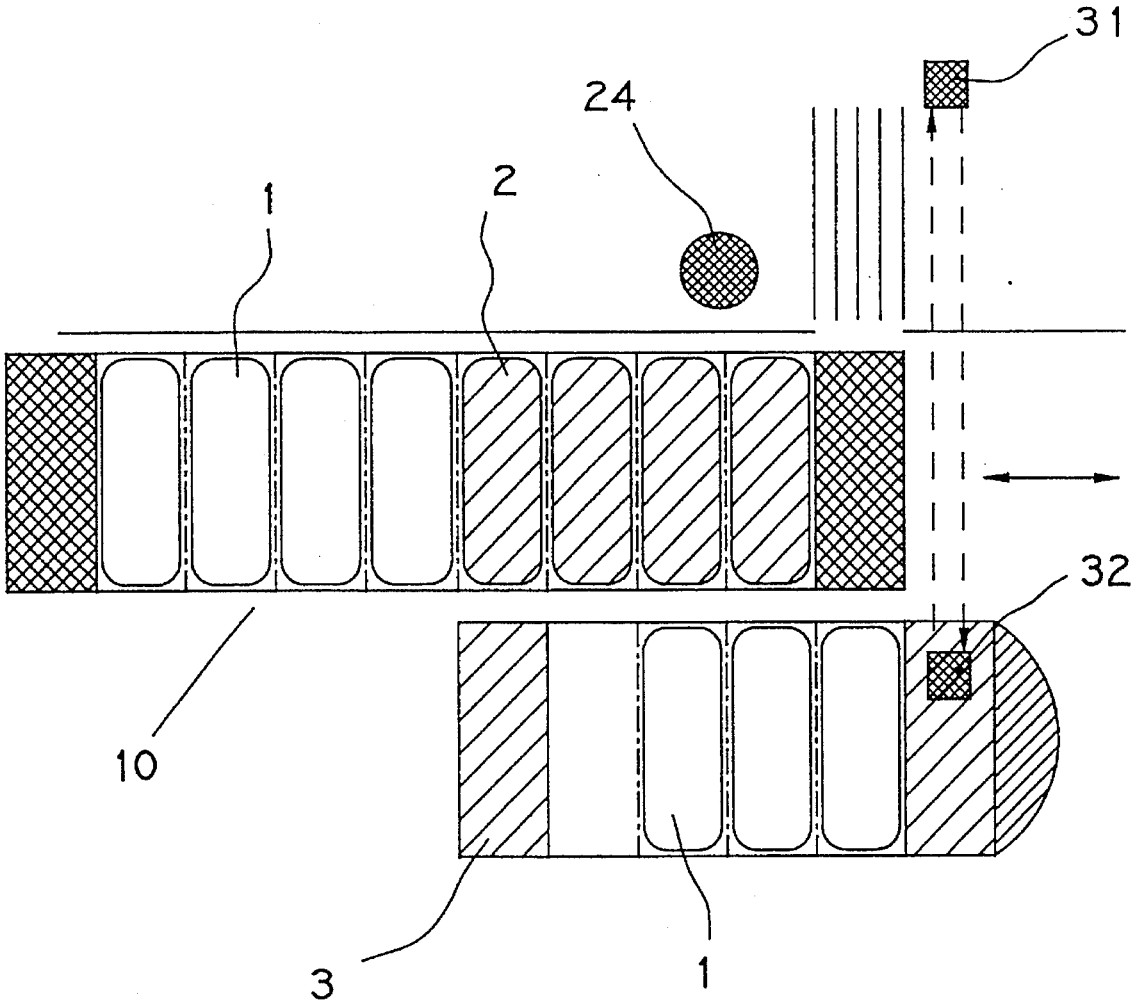
FIG. 8 shows a device immediately before the can replacement process.

FIG. 8 schematically shows a device immediately before the can exchange. In this embodiment, a free can holding space is provided on the can conveying vehicle 3. The can conveying vehicle 3 has a total of four can holding spaces, with three can holding spaces being occupied by empty cans 1. The can conveying vehicle 3 is at the stop at which it is connected to the controls for the movement of carriage 10 by means of communication devices 31, 32 in the form of light barriers. Each of the light barriers 31, 32 is equipped with a receiver and a transmitter so that signals for further action can be exchanged among them. During the entire can exchange operation the can conveying vehicle 3 remains stationary at this stop and is advantageously able to constantly exchange signals with the controls for carriage movement. The controls for carriage movement of the carriage 10 in the form of a storage device act upon the friction wheel drive 24 which moves the carriage 10 back and forth and stops in whatever can transfer position is required. Empty cans 1 and full cans 2 are placed on the carriage 10.

In the shown advantageous embodiment of the invention, the can conveying vehicle 3 conveys several cans. In order to dispose of a free can holding space at the conveying destination of the can conveying vehicle 3 for the empty can to be exchanged, the shown can conveying vehicle 3 is capable of conveying three cans. The controls of the carriage 10 check the cans placed on the carriage 10 for the point in time at which they are to be filled and, in keeping with the available conveying capacity of three cans on the can conveying vehicle 3, selects the three oldest cans 2 for transfer from carriage 10 to can conveying vehicle 3. The position of carriage 10 shown in FIG. 8 is such that the full can 2 standing across from the free can holding space on the can conveying vehicle 3 belongs to the three oldest full cans 2. When this full can 2 has been transferred to the can conveying vehicle 3 the carriage 10 is moved on step by step for the transfer of the empty can 1 of can conveying vehicle 3 to the liberated can holding space on carriage 10. The carriage 10 is then again moved on step by step until the next reachable full can among the previously selected three oldest full cans is standing across from the empty can holding space of the can conveying vehicle 3. This is followed by the transfer of the full can 2 to the can conveying vehicle 3. The process continues in the same manner until the three oldest cans have been transferred to the can conveying vehicle 3. The fourth full can 2 which was originally on the carriage 10 is now recorded as the oldest can for the next can exchange operation and is marked for the exchange.

In this exchange principle it is essential that it not be the oldest can which is exchanged first, but that always the first can to be reached be exchanged from among the number of cans to be exchanged. As a result the exchange times are considerably shorter since the carriage 10 need be moved by only a short distance. It is a further advantage in this exchange process that the entire possible displacement of the carriage 10 may be reduced. Thanks to the process described above it is not necessary for the can shown in FIG. 8 at the extreme right on the outside on carriage 10 to be assigned to the can holding space at the extreme left on the can conveying vehicle 3. The same also applies to the outermost left can holding space 5 on carriage 10 with respect to the outermost right can holding space on can conveying vehicle 3. The carriage 10 must therefore be capable of being displaced by at least two can holding spaces. The reduced overall displacement of the carriage 10 thus results in a quicker exchange operation.

The communication between the two light barriers 31 and 32 is described below through an example. Each of the light barriers is able to produce a low signal and a high signal which is recognized by the corresponding light barrier. If the device is installed along a path where the cans are filled the light barrier 31 is in "low" state while the empty cans are taken from the carriage 10, are filled beneath the path and are then pushed back on the carriage 10. When the can conveying vehicle 3 has arrived at the stop and has been positioned the light barrier 32 indicates by a high signal that it is calling for a can exchange. The controls which have received this call signal from the receiver of the light barrier 31 positions the carriage 10 so that one of the oldest full cans to be transferred is standing across from the free space on the can conveying vehicle 3. It is determined at the same time which of the oldest cans may be transferred to the free space on the can conveying vehicle 3 while taking into account the shortest displacement distance and possibly also whether a given can holding space on the carriage 10 can be associated with a given can holding space on the can conveying vehicle 3. Often the next can 2 to be transferred is, as seen in the direction of movement of the can conveying vehicle, the can 2 standing next to the previously transferred can 2.

When the carriage 10 has reached the appropriate exchange position the can exchange is released. The release is prompted by a high signal of the light barrier 31. During the passage of the full can from the carriage 10 to the can conveying vehicle 3, the transmission signal of the light barrier 32 is set to "low". As soon as the can 2 has been accepted, the end of the exchange operation is indicated by a high signal of the light barrier 32. Thereupon the signal of the light barrier 31 is again set to "low" and the carriage 10 is shifted by one position for the transfer of an empty can to the liberated space on carriage 10. The signalling of the light barriers 31 and 32 is analogous for the transfer of an empty can.

The signals of the light barriers 31 and 32 ensure that the can exchange from carriage 10 to vehicle 3 and vice versa is not interrupted by a can exchange along the path. Such an interruption would lead to a delay and to interference in the can exchange under certain circumstances.

The shown invention is not limited to a storage device at a fiber-sliver producing machine but may also be applied to a storage system which is independent of the fiber-sliver producing machine. The storage system would then be provided with mobile carriages 10 which, when emptied, would be exchanged against carriages 10 with full cans. The instant invention is not limited to the described embodiments. In fact, it will be apparent to those skilled in the art that various modifications and variations may be made in the invention without departing from the scope or spirit of the invention. It is intended that the present invention cover all such modifications and variations as come within the scope of the appended claims.

We claim:

1. A process for storage of textile cans in a storage device at a textile machine which is supplied with empty cans from the storage device and from which full cans are conveyed to the storage device, the storage device having a longitudinal length for storing adjacently disposed cans, said process comprising providing a can grasping device adjacent to the storage device, the can grasping device being stationary relative to the storage device; moving a can conveying vehicle to a stationary position adjacent the storage device; and replacing full cans on the storage device with empty cans with the stationary can grasping device by selectively displacing the storage device longitudinally relative to the stationary grasping device and conveying vehicle in a series of predetermined steps so that either one of an empty can holding space, an empty can, or a full can on the storage device is brought to the can grasping device at any given step by movement of the storage device.

2. The process as in claim 1, further comprising transferring a full can from the storage device with the grasping device while simultaneously filling another can with the textile machine.

3. The process as in claim 1, wherein for each full can transferred from the storage device an empty can is transferred to the storage device.

4. The process as in claim 1, further comprising depositing full cans from the textile machine to one side of the storage device and transferring empty cans to the storage device at another side of the storage device.

5. The process as in claim 4, further comprising continuously providing an empty can holding space on the storage device between the full cans and the empty cans on the storage device.

6. The process as in claim 5, comprising defining the empty can holding space by transferring the empty can adjacent the full cans from the storage device to the textile machine for filling.

7. The process as in claim 6, further comprising transferring the full can adjacent the empty can holding space from the storage device, and transferring an empty can to the empty can holding space.

8. The process as in claim 1, further comprising designating the full cans on the storage device the longest period of time as the oldest full cans, and transferring the designated oldest cans from the storage device in a transfer wherein a plurality of full cans are transferred in said series of predetermined steps so that a shortest overall longitudinal displacement movement distance is defined for the storage device relative to the grasping device for transfer of all oldest designated cans.

9. A process for storage and removal of a row of textile cans with a storage device operably disposed adjacent to a can filling textile machine, the row of cans containing any combination of full and empty cans, said process comprising defining a first empty can holding position within the row of cans on the storage device; moving a can conveying vehicle into a stationary position adjacent the storage device; transferring an empty can from the conveying vehicle to the first empty can holding position; transferring a full can from the storage device to a Can accepting position on the conveying vehicle thereby defining a second empty can holding position on the storage device; displacing the storage device relative the conveying vehicle so that the second empty can holding position is at the same position relative the conveying vehicle as was the first empty can holding position for a subsequent can transfer.

10. A process for storage and removal of a row of textile cans with a storage device operably disposed adjacent to a can filling textile machine, the row of cans containing any combination of full and empty cans, said process comprising moving a can conveying vehicle into a position adjacent to the storage device, the can conveying vehicle having an empty position for receiving a full can from the storage device and an empty can for transferring to the storage device; transferring a full can from the storage device to the empty position of the can conveying vehicle thereby defining an empty can holding space on the storage device; shifting either of the storage device or can conveying vehicle by one can position so that the empty can on the can conveying vehicle is across from the empty can holding space on the storage device; transferring the empty can from the can conveying vehicle to the empty can holding space; and if the storage device was previously shifted so that the empty can on the conveying vehicle was across from the empty can holding space, displacing the storage device by one can position in a direction opposite to its previous shifting displacement.

11. A process for storage and removal of a row of textile cans with a storage device operably disposed adjacent to a can filling textile machine, the row of cans containing any combination of full and empty cans and at least a first empty can holding position within the row of cans on the storage device; said process comprising moving a can conveying vehicle into a position adjacent the storage device; displacing the storage device longitudinally by one can position so that the first empty can holding position on the storage device is across from an empty can on the can conveying vehicle; transferring an empty can from the can conveying vehicle to the first empty can holding position on the storage device; and transferring a full can from the storage device to a can accepting position on the can conveying vehicle.

12. The process as in claim 11, wherein the exchange of an empty can with a full can on the storage device is conducted so that an empty holding space is defined on the storage device between empty cans and full cans.

13. The process as in claim 12, wherein the can conveying vehicle defines an empty position for receiving a full can and a position having an empty can, said process comprising initially positioning the can conveying vehicle relative the storage device so that the position thereon having an empty can is across from the empty holding space on the storage device, and the empty position thereon is across from a full can on the storage device.

14. A device for storage of textile cans at a can filling textile machine, said device comprising a storage device disposed adjacent said textile machine, said storage device having an overall length for storage of adjacently disposed cans, said storage device further comprising a movable carriage configured to move in either longitudinal direction relative the length of said storage device; a stop defined in the area of movement of said carriage; and a movable can conveying vehicle disposed to travel alongside said carriage to a predetermined position defined by said stop for transfer of full or empty cans with said carriage; said carriage configured to move in either longitudinal direction relative said stopped vehicle for exchange of cans therewith.

15. The device as in claim 14, further comprising communication devices configured at said stop for operably connecting controls of said carriage and said vehicle for controlling and coordinating relative movement therebetween.

16. The device as in claim 15, wherein said communication devices comprise light barrier devices associated with each of said vehicle and said carriage, each light barrier device configured with a transmitter and a receiver.

17. The device as in claim 14, wherein said carriage comprises any combination of empty and full cans, with any said empty cans being at one end of said carriage and any said full cans being at an opposite end of said carriage.

18. The device as in claim 19, wherein said carriage further comprises an empty can holding space defined between said empty and full cans.

19. The device as in claim 14, wherein said carriage is configured for exchanging cans at either side thereof.

20. The device as in claim 14, further comprising a friction wheel drive for moving said carriage in either longitudinal direction, said carriage comprising a frictional surface disposed to engage said friction wheel drive.

21. The device as in claim 20, further comprising an opposing roller disposed so as to bear against said friction wheel drive with said carriage frictional surface running therebetween.

22. The device as in claim 14, wherein said carriage comprises a device for adjusting the loading height thereof to be alignable with a loading and unloading device.

23. The device as in claim 14, wherein said carriage comprises lateral guides defining can holding spaces thereon.

24. The device as in claim 23, wherein said carriage comprises at least one more can holding space than a number of cans to be filled by said textile machine.

25. The device as in claim 23, wherein each said can holding space further comprises an aligning mechanism for ensuring that said respective can holding space is properly positioned relative to a can grasping device for a can transfer.

26. The device as in claim 25, wherein said aligning mechanism comprises sensor recesses associated with each can holding space which are detected by a sensor device operably configured with a driving mechanism for longitudinally moving said carriage.

27. The device as in claim 14, wherein said carriage comprises a width which is less than the can diameter for round cans and less than the can length for flat cans.

28. The device as in claim 14, wherein said storage device further comprises at least one longitudinal guide disposed to engage and ensure precise positioning of said carriage relative said textile machine.

* * * * *

UNITED STATES PATENT AND TRADEMARK OFFICE

CERTIFICATE OF CORRECTION

PATENT NO. : 5,471,711

DATED : DECEMBER 5, 1995

INVENTOR(S) : OTMAR KOVACS ET AL.

It is certified that error appears in the above-identified patent and that said Letters Patent is hereby corrected as shown below:

On the title page [19], change the name on the face of the patent from "Koyacs et al." to --Kovacs et al.--.

IN THE CLAIMS

Claim 18, column 12, line 2, delete "19" and substitute therefor --17--.

Signed and Sealed this

Twenty-first Day of December, 1999

*Attest:*

Q. TODD DICKINSON

*Attesting Officer*

*Acting Commissioner of Patents and Trademarks*